US006375523B1

(12) United States Patent
Mathias

(10) Patent No.: US 6,375,523 B1
(45) Date of Patent: Apr. 23, 2002

(54) PERSONAL WATERCRAFT (PWC) VARIABLE INLET/INTAKE GRATE

(76) Inventor: Eric Kyle Mathias, 1112 S. Clark Rd., Cedar Hill, TX (US) 75104

( * ) Notice: Subject to any disclaimer, the term of this patent is extended or adjusted under 35 U.S.C. 154(b) by 0 days.

(21) Appl. No.: 09/342,262

(22) Filed: Jun. 29, 1999

Related U.S. Application Data

(60) Provisional application No. 60/115,964, filed on Jan. 15, 1999.

(51) Int. Cl.[7] ..... B63H 11/103
(52) U.S. Cl. ..... 440/47; 440/46
(58) Field of Search ..... 440/38, 46, 47

(56) References Cited

U.S. PATENT DOCUMENTS

| | | | | | |
|---|---|---|---|---|---|
| 3,253,567 | A | * | 5/1966 | Patton, Jr. | 440/47 |
| 3,343,368 | A | * | 9/1967 | Castoldi | 440/47 |
| 3,430,640 | A | * | 3/1969 | Lennard | 440/47 |
| 3,757,728 | A | * | 9/1973 | Rhoda | 115/16 |
| 3,942,463 | A | * | 3/1976 | Johnson, Jr. et al. | 115/11 |
| 3,985,094 | A | * | 10/1976 | Stricker | 115/14 |
| 4,027,617 | A | * | 6/1977 | Ikeda et al. | 115/14 |
| 4,373,919 | A | * | 2/1983 | Stangeland | 440/47 |
| 4,449,944 | A | * | 5/1984 | Baker et al. | 440/47 |
| 4,775,341 | A | * | 10/1988 | Tyler et al. | 440/38 |
| 5,114,368 | A | * | 5/1992 | Moyle et al. | 440/47 |
| 5,199,913 | A | * | 4/1993 | Toyohara et al. | 440/47 |
| 5,234,361 | A | * | 8/1993 | Dickinson et al. | 440/47 |
| 5,324,216 | A | * | 6/1994 | Toyohara et al. | 440/47 |
| 5,700,169 | A | * | 12/1997 | Jones | 440/46 |
| 5,779,508 | A | * | 7/1998 | Pettesch et al. | 440/46 |
| 5,910,033 | A | * | 6/1999 | Norrstrand | 440/47 |
| 5,989,083 | A | * | 11/1999 | Ishigaki et al. | 440/46 |
| 6,004,173 | A | * | 12/1999 | Schott | 440/38 |
| 6,024,614 | A | * | 2/2000 | Burg | 440/41 |

FOREIGN PATENT DOCUMENTS

| | | | | |
|---|---|---|---|---|
| IT | 652324 | * | 9/1993 | 440/46 |
| JP | 65490 | * | 3/1991 | 440/46 |
| JP | 404243688 | * | 8/1992 | 440/46 |
| JP | 405229481 | * | 9/1993 | 440/46 |
| RU | 689887 | * | 10/1979 | 440/47 |
| RU | 867783 | * | 10/1981 | 440/38 |

* cited by examiner

*Primary Examiner*—S. Joseph Morano
*Assistant Examiner*—Ajay Vasudeva

(57) ABSTRACT

An inlet grate mounted within the inlet channel of a watercraft, where the inlet grate contains a pivotally mounted divider vane disposed laterally across the inlet channel and biased by a torsional spring into a neutral position. The hydrodynamic forces of water moving through the grate alter the angle of the lateral vane, thus inducing equality of upper and lower inlet water volumes as well as pressure, proportionate to watercraft speed, thereby improving the efficiency of the watercraft's jet pump assembly without requiring the use of electromechanical devices.

18 Claims, 7 Drawing Sheets

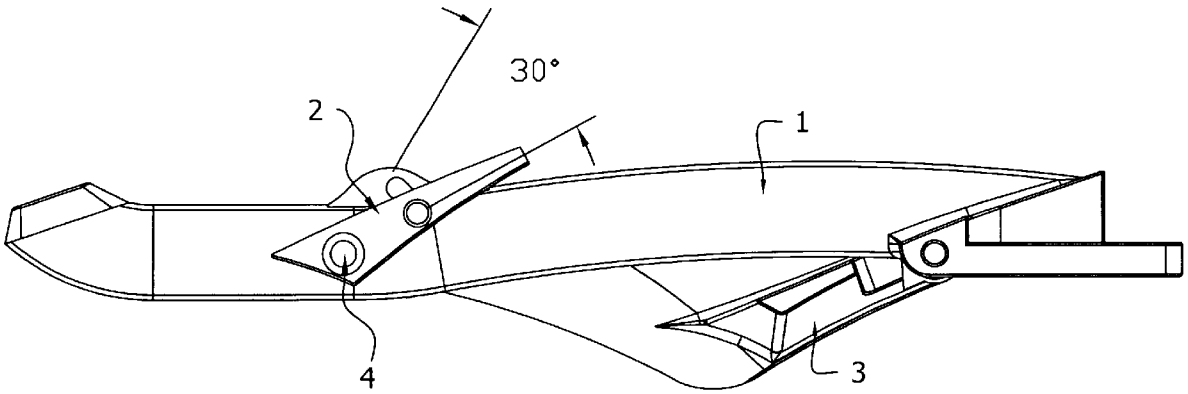
FIG. IA
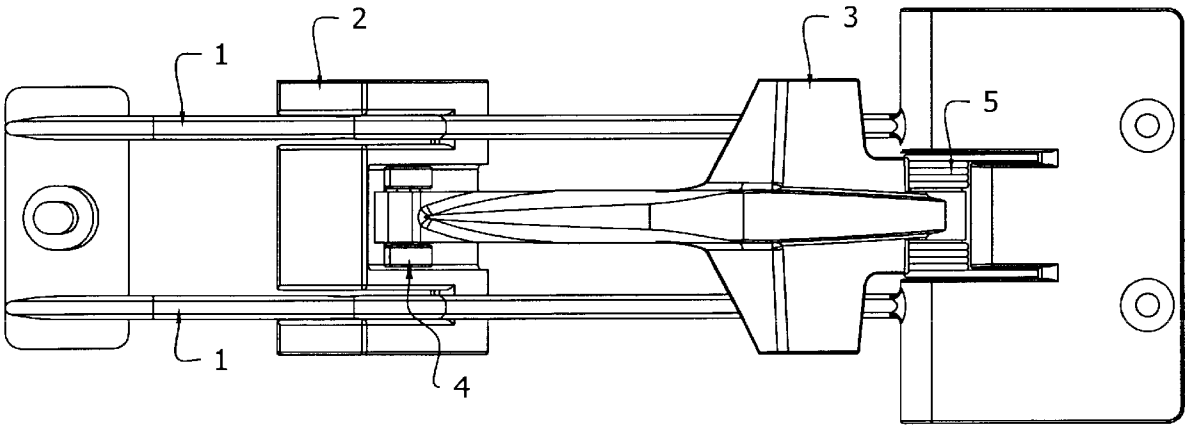
FIG. IB

PERSONAL WATERCRAFT (PWC) VARIABLE INLET/INTAKE GRATE

CROSS-REFERENCE TO RELATED APPLICATIONS

This utility patent application references a preceding provisional application with foreign filing license granted Jan. 1, 1999 application No. 60/115,964.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

The invention contained herein entitled "Personal Watercraft Variable Inlet/Intake Grate" pertains to improvements made in the design and manufacture of inlet grates located beneath the hull of said watercraft prior to the jet pump assembly or impeller (see FIGS. 3,4), to which water is directed by an intake or inlet channel in the underside of the hull of the watercraft. The purpose of the conventional inlet grate is to provide protection against foreign objects entering the jet propulsion system, which may cause severe damage to the jet pump and/or one of its components. Furthermore, inlet/intake grates also exist to increase or improve pump pressure/flow of water through the jet pump assembly thus dramatically improving performance and handling of the watercraft. Due to the widespread growth of the sport, jet watercraft recreation, enhancements in the design, and/or manufacture of after market inlet grates has become a highly competitive business. The introduction of "variable" technology to the design/manufacture of inlet grates will provide a solution to many performance problems associated with personal watercraft marine vehicles.

Current technology is this area consists of improvements made to current watercraft manufacture inlet grates. Typically, stock inlet/intake grates consist of a main grate generally containing a single diagonal plate/scoop. Stock inlet grates provide reasonable performance in smooth water conditions, however they lend themselves to problems of cavitation due to the inability to provide consistent pump pressure (flow to the pump or impeller) in cornering and in rough water conditions. Stangeland, U.S. Pat. No. 4,373,919 discloses an adjustable angle top loading plate, which is pivotally connected to the hull of a vessel. By the use of mechanical/electronic means and/or sensors, which measure the engine performance or speed of the watercraft, it succeeds in splitting the flow of water into upper and lower portions while varying the inlet area. However, this requires extensive, unnecessary alterations to the water craft and employment of unusual manufacturing techniques and is not easily adaptable to various watercraft as is the invention contained herein. Furthermore, the prior art fails to provide consistent pump pressure in cornering due to side support members. The prior art provides an equality of upper and lower portions but fails to provide a substantial increase in pump pressure as needed for increased torque and acceleration. Finally, the Strangeland design lends itself to dramatic increases in drag which causes a significant decrease in top speed performance. Tyler et al, U.S. Pat. No. 4,775,341 discloses a water directing apparatus which was provided for use on what is commonly referred to as a wetbike. Unlike personal watercraft currently produced, it contained a combination of skis rather than a hull common to most current marine vehicles. However, Tyler et al disclosed a series of laterally spaced fins which are positioned at various angles of attack, thus providing an upper and lower stream of water to the jet pump assembly. The patent disclosed by Tyler et al has led to the typical design of stock and after market intake grates currently on the market provided for modern personal watercraft vehicles. Tyler et al however, also discloses a second embodiment containing a lateral vane, which is pivotally connected to the inlet channel of the watercraft. This vane allegedly responded to increased pressure as a result of increasing speed. Although, the principle is similar to that contained herein, specific problems must have been obvious. This vane being pivotally connected to the inlet channel, similar to that disclosed by Strangeland as mentioned above, would effectively vary pump pressure with watercraft speed but would fail to provide full saturation of the impeller housing which leads to a loss of top speed performance. Furthermore, this device fails to offer protection of foreign objects from entering the inlet channel, which could lead to damage to pump components, and more importantly, serious injury to the rider could occur. Moyle et al U.S. Pat. No. 5,114,368 discloses a shaft shielding top loader which effectively divides the flow into upper and lower portions but is accomplished by a fixed top loading plate. It succeeds in providing improved acceleration and pump pressure, but provides a decrease in top end performance. Due to its inability to make necessary adjustments in pitch/angle to vary pump pressure as operating conditions require, it provides increased drag/turbulence and fails to provide a smooth flow which greatly reduces top end performance. It is a combination of some of these principles of the prior art, that lead to the improvement in inlet/intake grates, provided for use on modern personal watercraft containing a hull, that is contained herein.

BRIEF SUMMARY OF THE INVENTION

The introduction of variable technology to the design/manufacture of inlet/intake grates will dramatically increase overall performance and handling of the watercraft and will be easily adaptable to various type/models thereof. Furthermore, it will provide a solution to the problems associated with the prior art as mentioned above. Variable inlet grates will increase pump pressure and improve overall performance by consistently providing a smooth flow of water through the pump assembly under all conditions. Under acceleration, when increased pump pressure is necessary, the variable inlet grate will provide an increase in water flow to the pump assembly thus increasing torque, which will dramatically improve low and mid range acceleration. As the watercraft begins to reach top speed, the variable intake grate will utilize the natural effects of hydrodynamics to make necessary adjustments in pitch to maintain a smooth flow while minimizing cavitation and fully saturating the lower impeller housing. The result is improved overall performance and handling without sacrificing top end performance. The introduction of variable technology to the design of personal watercraft inlet grates, will provide results which could never be achieved through current fixed intake grates currently on the market. Current intake grates succeed in providing improved performance in some areas, but fail to improve overall performance in both low and mid range acceleration as well as provide superior handling at all speeds without sacrificing top end performance.

BRIEF DESCRIPTION OF DRAWINGS

FIGS. 1A and 1B are a left side, and bottom view of the first embodiment of Variable Inlet Grate at top end position.

DETAILED DESCRIPTION OF THE INVENTION

Figure 2A:
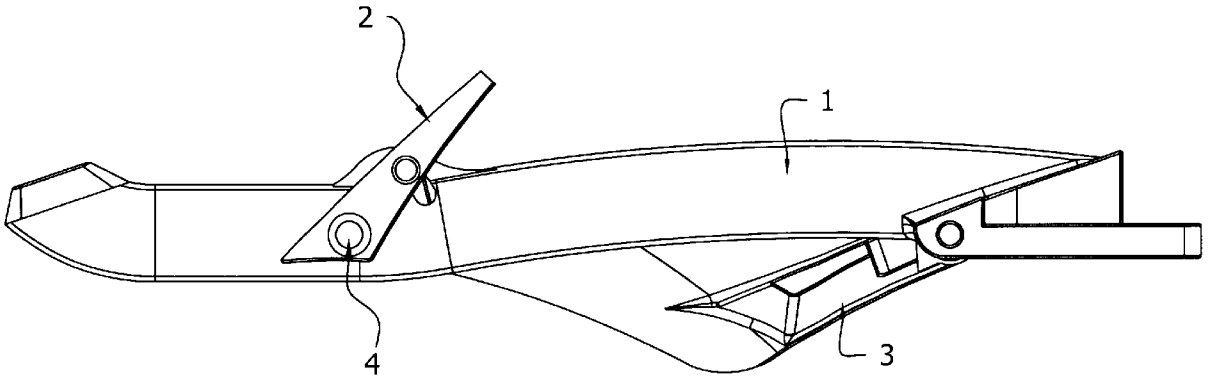
FIGS. 2A and 2B are a left side, and bottom view of the first embodiment of Variable Inlet Grate positioned at low to mid position.
Figure 2B:
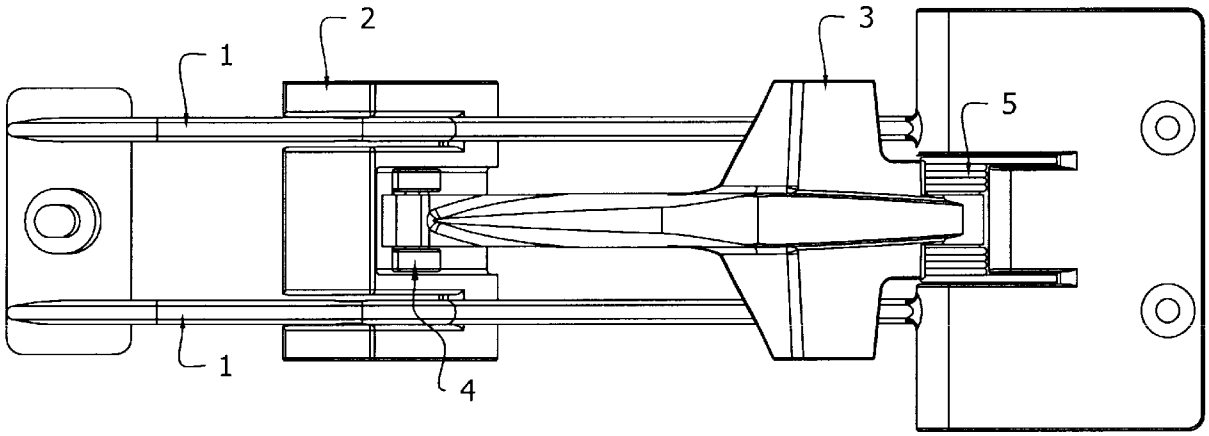
Figure 3:
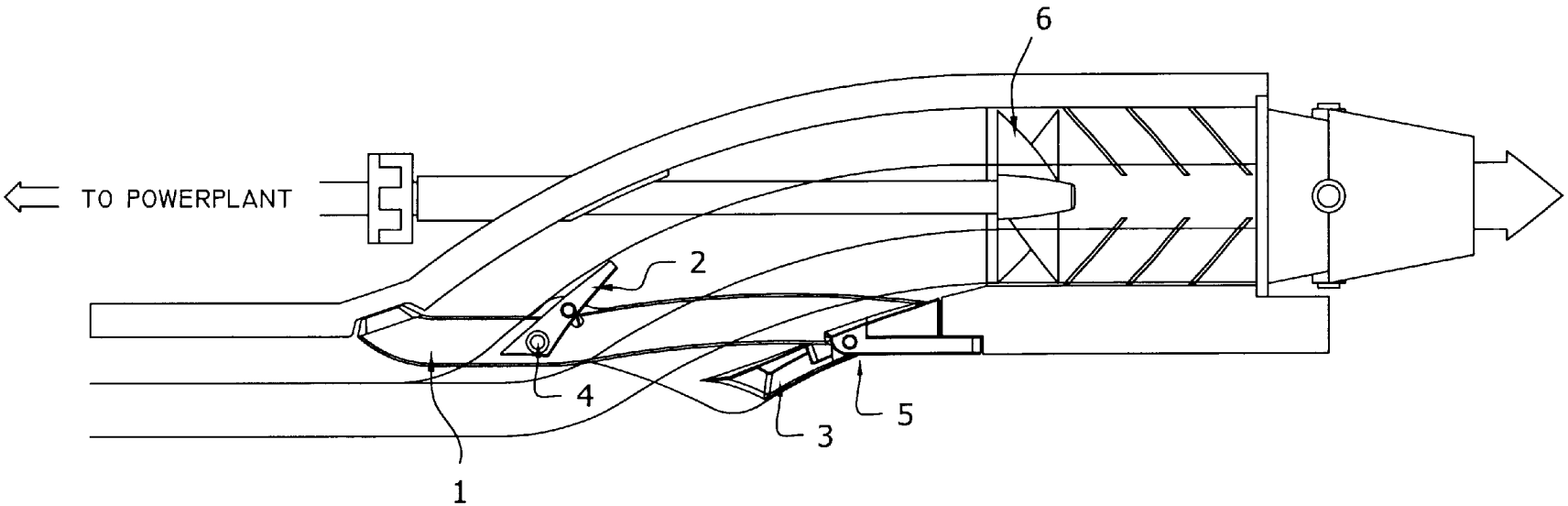
FIG. 3 is a flow diagram of a Typical Jet Propulsion Unit with first embodiment of variable inlet grate installed in low to mid range position.
Figure 4:
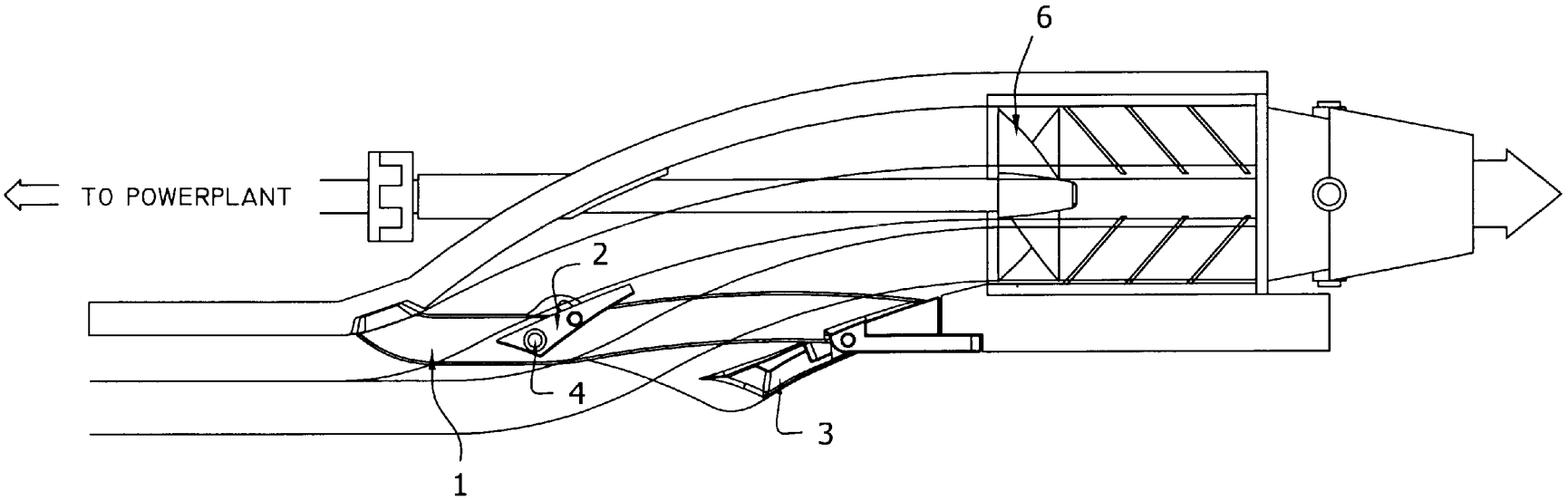
FIG. 4 is a flow diagram of a Typical Jet Propulsion Unit with first embodiment of variable inlet grate installed in top end position.
Figure 5:
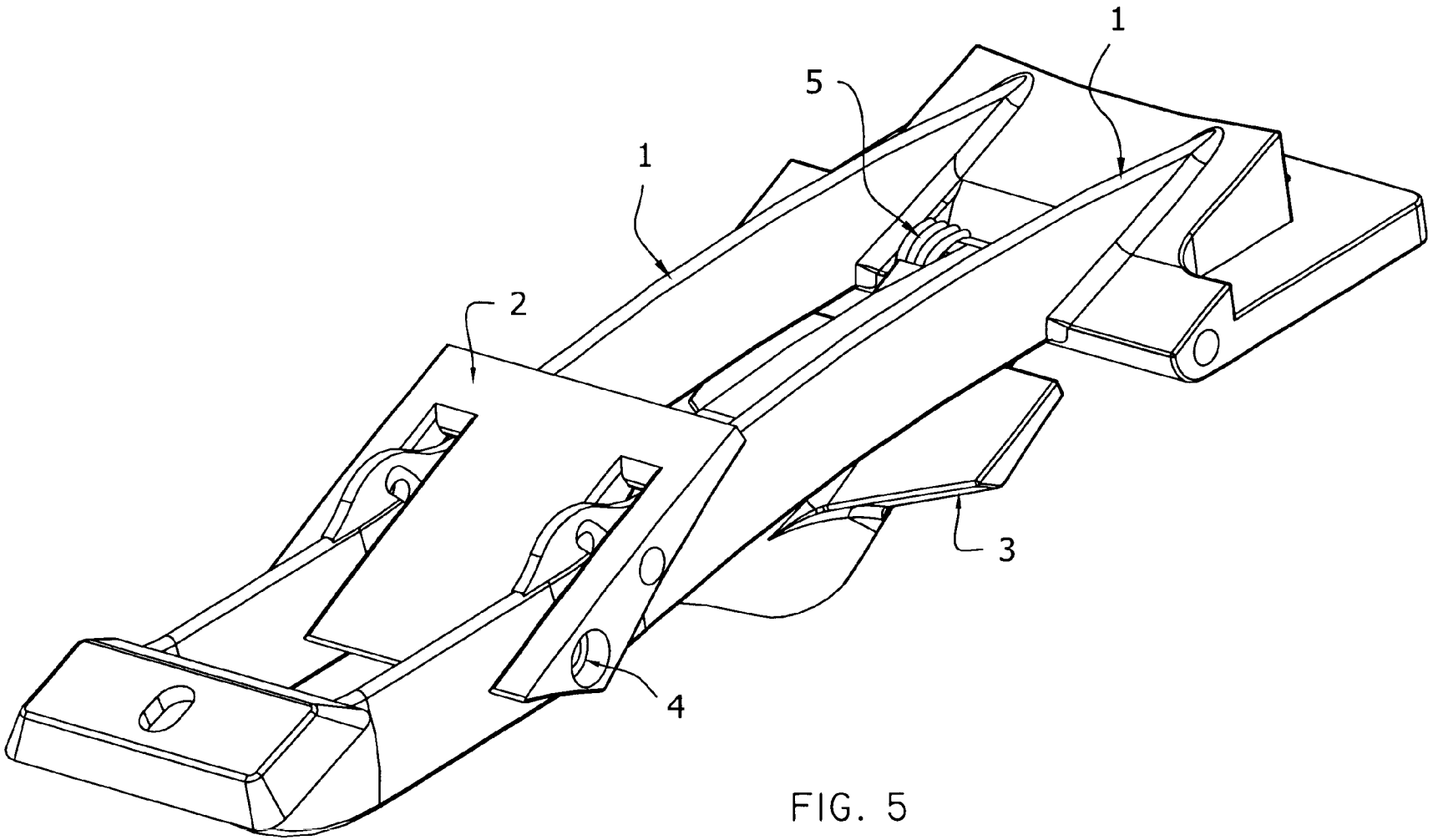
FIG. 5 is an isometric view of the first embodiment of a Variable Inlet Grate.

The following is a detailed description of the first embodiment of a variable inlet/intake grate, which maybe available for improved overall performance in all riding conditions. The first embodiment was developed with the recreational rider in mind, to provide improved acceleration and handling without sacrificing top end performance. Please note, the description and/or drawings to follow, outline the first embodiment of the invention. It is the intent of the invention that be understood, that it not be limited hereto but may contain variations of the embodied to practice within the scope of any/all claims contained herein.

All components of the variable intake assembly will initially be manufactured through an aluminum casting process known as aluminum foundry. Under this process, a match plate is produced which may consist of numerous parts/castings located on a board. This match plate is then registered by the foundry machine, which produces a single use sand mold of both sides of the part being produced. The molds are then separated and the match plate set aside.

Finally, the molds are reassembled and molten aluminum alloy is poured/injected into the mold. Once the molten aluminum is cooled, the molds are destroyed and the parts are revealed. This process can be used with many alloys of aluminum. However, since these parts are continually exposed to high corrosion marine conditions, an alloy known as Almag 35 will be used. This alloy delivers very high strength and corrosion resistance among its many properties. This process provides quality castings that are relatively inexpensive and widely used in the manufacture of personal watercraft intake grates.

The first embodiment of the variable intake grate, (FIGS. 1–5) consists of four parts. A mounting structure referred to as the main grate or frame consisting of a pair of spaced-apart rails (1), an upper or forward scoop or vane (2), lower or aft scoop or vane (3), both of which are transversely and secured to rails (1), and an attachment component referred to as the lower bracket (4). The main grate (1) contains the bolting locations required for the watercraft. It is necessary also to provide structure or support of the following.

The first of these is a top loading upper scoop or vane (2), which will provide consistent water flow to the upper pump assembly, specifically the impeller. It will accomplish this by making necessary adjustments in pitch or angle (within a range of 0 to 90 degrees relative to horizontal). For example, when the watercraft is at rest with no water velocity acting on it, the upper scoop (2) will remain in a high pitch angle or upward position. This is achieved by utilizing a series of high strength stainless steel torsion springs (5) attached to the rear of the lower scoop (3), which may be custom designed to "fine tune" the desired performance of the watercraft. This resistance (of the springs) is mechanically transferred to the upper scoop (2) by way of the linkage or coupling between the upper (2) and lower (3) vanes and lower bracket (5) as mentioned above. As the watercraft begins to accelerate, the natural forces of hydrodynamics will take place (water velocity will increase and dynamic pressure is exerted on scoop or vane (2)) causing the upper scoop (2) to decrease in pitch (angle relative to horizontal) as the speed increases. This effect is enhanced by the hydrofoil design of the upper (2) and lower (3) scoops and will result in decreased drag as the watercraft reaches top speed. Thus the upper scoop (2), by changing pitch or angle as water and watercraft velocity increase (and decrease) will consistently maintain a smooth flow of water through the pump assembly allowing for maximum pump pressure and increased acceleration without sacrificing top end performance. The lower scoop (3) exists to provide full saturation of the lower pump assembly and to minimize cavitation, which will provide superior handling in both smooth and rough water conditions. This effect is achieved due to the fact that steering control of the watercraft is achieved by movement of the steering control nozzle, which is common to all jet skis/personal watercraft.

By examining the flow diagrams of the first embodiment (FIGS. 3,4) contained herein, it is evident that the embodied successfully divides the incoming flow into upper and lower partitions (FIG. 3) under acceleration and/or mid range performance (at lower velocities). This is necessary to provide increased pump pressure on the impeller blade (6), which leads to increased torque as the watercraft is under acceleration. However, as top speed is reached (FIG. 4), it also succeeds in providing a smooth consistent flow of incoming water while dramatically reducing unwanted drag/turbulence, thus providing for full saturation of the impeller housing and maximizing top speed performance.

Figure 6:
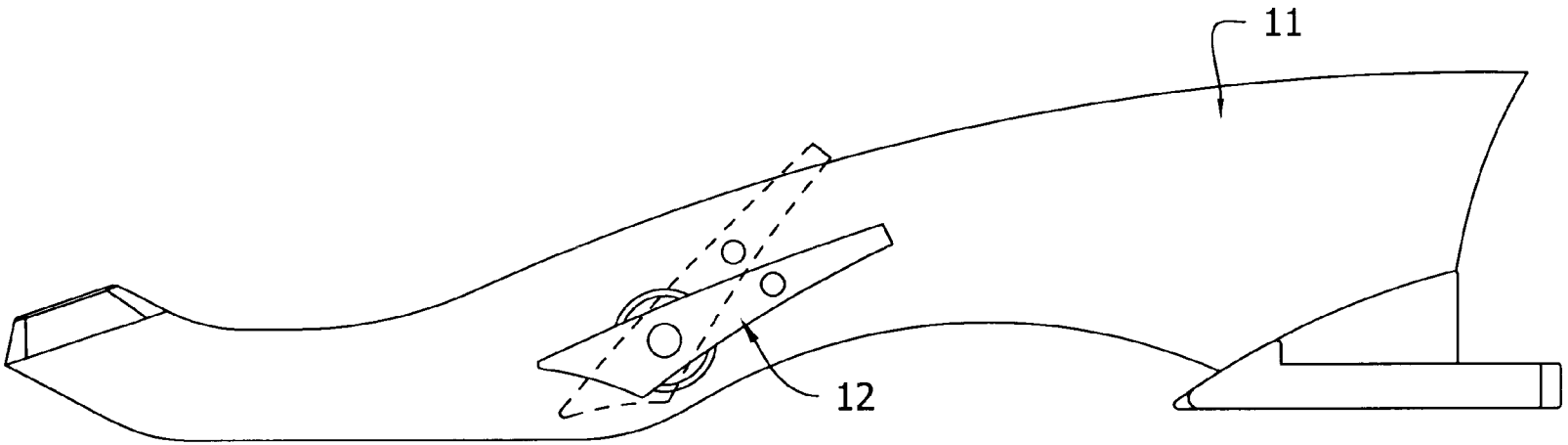
FIG. 6 is a left side view of the second embodiment of the invention.
Figure 7:
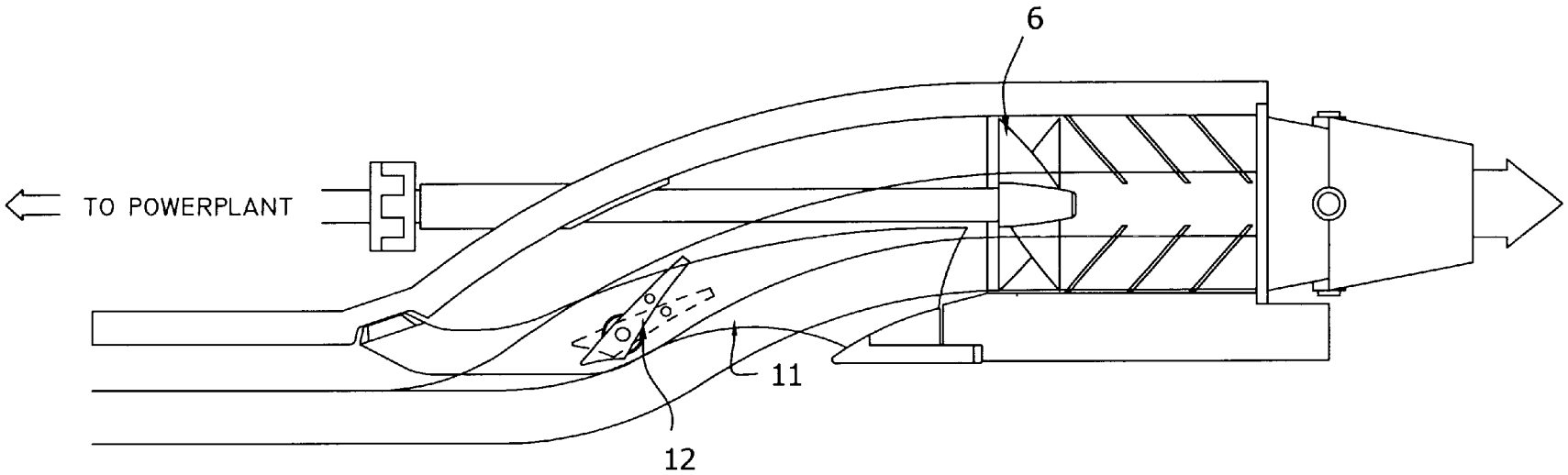
FIG. 7 is a flow diagram of a Typical Jet Propulsion Unit with second embodiment installed, low to top end position.

The second embodiment of invention, (FIGS. 6,7) contained herein operates under the same principles of the first embodiment (wherein the scoop or vane adjusts its angle responsive to water velocity). As is illustrated, the frame comprises a single rail (11) extending longitudinally across the center of the intake channel (not shown.) The single scoop or vane extends (12) transversely across the rail and functions generally similarly to the upper scoop or vane shown in connection with the first embodiment.

Due to the lack of the lower scoop however, the second embodiment may not provide the level of handling as that of the first embodiment. It shall, however, provide a significant increase in handling over typical manufactures stock inlet/intake grates and improve on that which is taught by Moyle et al U.S. Pat. No. 5,114,368. Although it is similar to that disclosed by Moyle et al, as mentioned above, the second embodiment will contain a variable pitch top loading scoop/plate. This will allow the second embodiment of the invention contained herein to not only provide improved acceleration and handling, but also provide an increase in top speed performance. This will be achieved though dramatic decreases in drag/turbulence as a result of adjustments in pitch which are not possible under the prior art, as disclosed by Moyle et al and those as previously discussed above.

What is claimed is:

1. An improved intake system for a jet-propelled watercraft having a hull and a longitudinally extending intake channel in an underside of the hull for delivering a flow of water to an impeller, the intake system comprising:

a frame adapted to be secured within the intake channel and to extend longitudinally across the intake channel;

at least one vane adapted to extend transversely across the intake channel, but spaced-apart from all surfaces of the intake channel, and secured to the frame, the vane disposed for dividing water flowing in the intake channel into upper and lower portions for delivery to the impeller;

the vane being movably secured to the frame so that its angle relative to the intake channel and frame varies in response to a velocity of water flowing through the intake channel.

2. The intake system according to claim 1, wherein a biasing means is provided to urge the vane into a neutral position when water is not acting on the vane.

3. The intake system according to claim 1, wherein the frame comprises a pair of spaced-apart rails adapted to extend longitudinally within the intake channel.

4. The intake system according to claim 1, wherein the frame comprises a single rail adapted to extend longitudinally within a central portion of the intake channel.

5. The intake system according to claim 1, wherein the angle of the vane is low relative to horizontal at high water velocity through the intake channel and high relative to horizontal at low water velocity through the intake channel.

6. The intake system according to claim 1 wherein the at least one vane comprises a forward vane and an aft vane.

7. The intake system according to claim 1, wherein the at least one vane comprises a single vane.

8. A combination of an improved inlet system and a jet-propelled watercraft, the watercraft having a hull and a longitudinally extending intake channel, in an underside of the hull for delivering a flow of water to an impeller, the combination comprising:

a frame secured within the intake channel and extending longitudinally across the intake channel;

at least one vane disposed in and extending transversely across the intake channel and secured to the frame, the vane dividing water flowing in the intake channel into upper and lower portions for delivery to the impeller;

the vane being movably secured to the frame so that its angle relative to the intake channel and frame varies in response to a velocity of water flowing through the intake channel, wherein the angle of the vane is low relative to horizontal at high water velocity through the intake channel and high relative to horizontal at low water velocity through the intake channel; and a biasing means provided between the vane and the frame to maintain the vane at a high angle relative to horizontal when no water is acting on the vane.

9. The combination according to claim 8, wherein the frame comprises a pair of spaced-apart rails extending longitudinally within the intake channel.

10. The combination according to claim 8, wherein the frame comprises a single rail extending longitudinally within a central portion of the intake channel.

11. The combination according to claim 8, wherein the at least one vane comprises a forward vane and an aft vane.

12. The combination according to claim 8, wherein the at least one vane comprises a single vane.

13. The combination according to claim 8, wherein the vane is spaced-apart from all surfaces of the intake channel for freedom of motion.

14. An improved intake system for a jet-propelled watercraft having a hull and a longitudinally extending intake channel in an underside of the hull for delivering a flow of water to an impeller, the intake system comprising:

a frame adapted to be secured within the intake channel and adapted to extend longitudinally across the intake channel;

at least one vane disposed in and secured to the frame and adapted to extend transversely across the intake channel, but spaced-apart from all surfaces of the intake channel, the vane dividing water flowing in the intake channel into upper and lower portions for delivery to the impeller;

the vane being movably secured to the frame so that its angle relative to the intake channel and frame varies in response to a velocity of water flowing through the intake channel, wherein the angle of the vane is low relative to horizontal at high water velocity through the intake channel and high relative to horizontal at low water velocity through the intake channel; and a biasing means to maintain the vane at a high angle relative to horizontal when no water is acting on the vane.

15. The intake system according to claim 14, wherein the biasing means is a torsion spring provided between the vane and the frame.

16. The intake system according to claim 14, wherein the frame comprises a pair of spaced-apart rails adapted to extend longitudinally within the intake channel.

17. The intake system according to claim 14, wherein the frame comprises a single rail adapted to extend longitudinally within a central portion of the intake channel.

18. The intake system according to claim 14, wherein the at least one vane comprises a forward vane and an aft vane.

* * * * *